US009222720B1

(12) United States Patent
Alba et al.

(10) Patent No.: US 9,222,720 B1
(45) Date of Patent: Dec. 29, 2015

(54) AIR CONDITIONER DRAINAGE SYSTEM

(71) Applicants: Johnangel Alba, Tampa, FL (US); Scarlett Y. Monroy-Alba, Tampa, FL (US)

(72) Inventors: Johnangel Alba, Tampa, FL (US); Scarlett Y. Monroy-Alba, Tampa, FL (US)

( * ) Notice: Subject to any disclaimer, the term of this patent is extended or adjusted under 35 U.S.C. 154(b) by 0 days.

(21) Appl. No.: 13/853,328

(22) Filed: Mar. 29, 2013

(51) Int. Cl.
*E02B 11/00* (2006.01)
*F25D 21/14* (2006.01)

(52) U.S. Cl.
CPC *F25D 21/14* (2013.01); *E02B 11/00* (2013.01)

(58) Field of Classification Search
USPC ..... 62/260, 331; 210/747.2, 170.03; 405/36, 39–41, 43–45
See application file for complete search history.

(56) References Cited

U.S. PATENT DOCUMENTS

| | | | | |
|---|---|---|---|---|
| 4,031,009 | A * | 6/1977 | Hicks | 210/164 |
| 4,134,269 | A * | 1/1979 | Arzet | 405/37 |
| 5,066,166 | A * | 11/1991 | Hansen | 405/128.6 |
| 5,086,594 | A * | 2/1992 | Florence | 52/169.5 |
| 7,722,763 | B2 * | 5/2010 | Benty et al. | 210/162 |
| 7,980,273 | B2 * | 7/2011 | Robinson | 138/44 |
| 2009/0285632 | A1 * | 11/2009 | Maggiacomo | 405/43 |

* cited by examiner

*Primary Examiner* — Sunil Singh

(57) ABSTRACT

An air conditioner drainage system has a housing in a cylindrical configuration positionable in a hole. The housing has a side wall with a closed bottom and an open top. The side wall is imperforate over the majority of its extent and has a plurality of wall apertures there through. A plurality of stones positionable within the hole beneath the bottom of the housing and laterally spaced from the wall apertures is adapted to provide widely extended dispersion of water from the housing.

1 Claim, 2 Drawing Sheets

FIG. 1
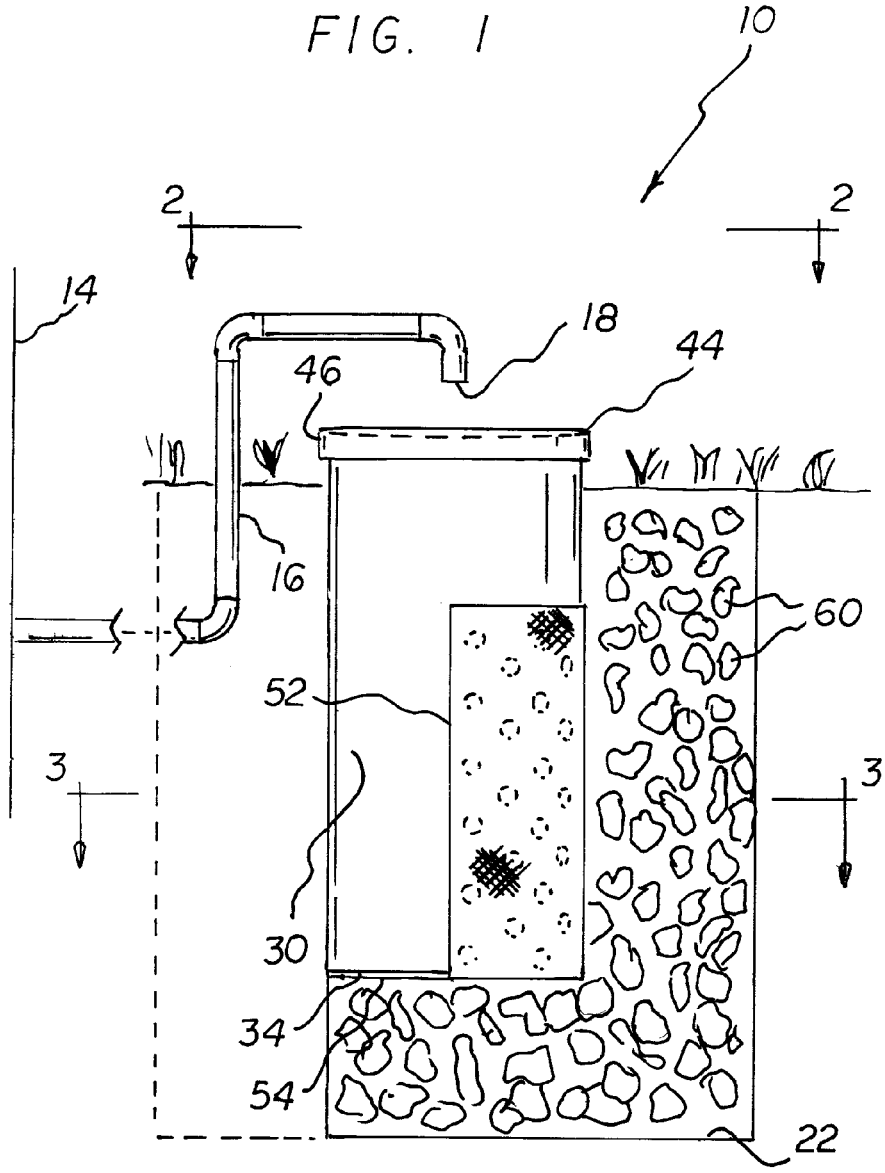
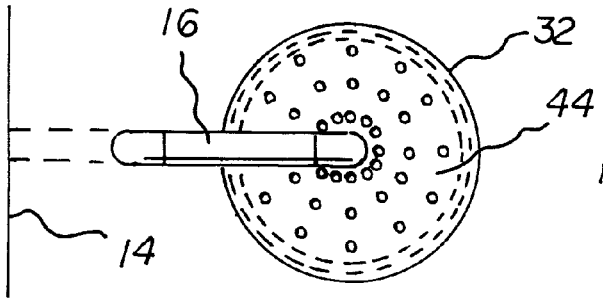
FIG. 2

FIG. 3
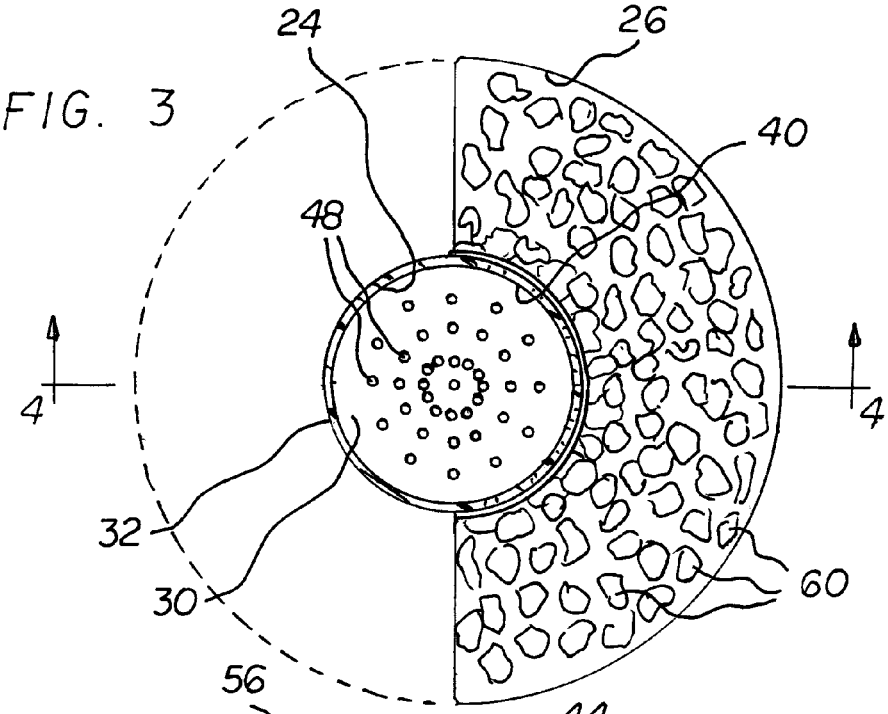
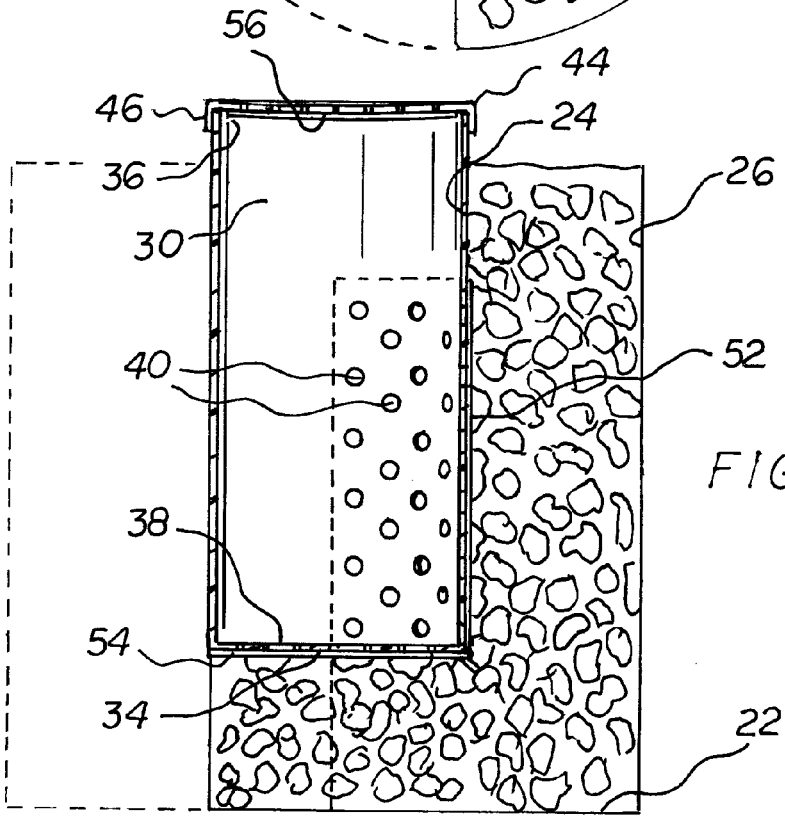
FIG. 4

AIR CONDITIONER DRAINAGE SYSTEM

BACKGROUND OF THE INVENTION

1. Field of the Invention

The present invention relates to an air conditioner drainage system and more particularly pertains to receiving drainage water from an air conditioner and dispersing the received water widely into the ground, the receiving and the dispersing being done in a safe, sanitary, ecological, convenient and economical manner.

2. Description of the Prior Art

The use of air conditioner drainage systems of known designs and configurations is known in the prior art. More specifically, air conditioner drainage systems of known designs and configurations previously devised and utilized for the purpose of draining water from air conditions are known to consist basically of familiar, expected, and obvious structural configurations, notwithstanding the myriad of designs encompassed by the crowded prior art which has been developed for the fulfillment of countless objectives and requirements.

While the prior are devices fulfill their respective, particular objectives and requirements, they do not describe an air conditioner drainage system that allows for receiving drainage water from an air conditioner and dispersing the received water widely into the ground, the receiving and the dispersing being done in a safe, sanitary, ecological, convenient and economical manner.

In this respect, the air conditioner drainage system according to the present invention substantially departs from the conventional concepts and designs of the prior art, and in doing so provides an apparatus primarily developed for the purpose of receiving drainage water from an air conditioner and dispersing the received water widely into the ground, the receiving and the dispersing being done in a safe, sanitary, ecological, convenient and economical manner.

Therefore, it can be appreciated that there exists a continuing need for a new and improved air conditioner drainage system which can be used for receiving drainage water from an air conditioner and dispersing the received water widely into the ground, the receiving and the dispersing being done in a safe, sanitary, ecological, convenient and economical manner. In this regard, the present invention substantially fulfills this need.

SUMMARY OF THE INVENTION

In view of the foregoing disadvantages inherent in the known types of air conditioner drainage systems of known designs and configurations now present in the prior art, the present invention provides an improved air conditioner drainage system. As such, the general purpose of the present invention, which will be described subsequently in greater detail, is to provide a new and improved air conditioner drainage system and method which has all the advantages of the prior art and none of the disadvantages.

To attain this, the present invention essentially comprises a housing in a cylindrical configuration positionable in a hole. The housing has a side wall with a closed bottom and an open top. The side wall is imperforate over the majority of its extent and has a plurality of wall apertures there through. A plurality of stones positionable within the hole beneath the bottom of the housing and laterally spaced from the wall apertures is adapted to provide widely extended dispersion of water from the housing.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved air conditioner drainage system which has all of the advantages of the prior art air conditioner drainage systems of known designs and configurations and none of the disadvantages.

It is another object of the present invention to provide a new and improved air conditioner drainage system which may be easily and efficiently manufactured and marketed.

It is further object of the present invention to provide a new and improved air conditioner drainage system which is of durable and reliable constructions.

An even further object of the present invention is to provide a new and improved air conditioner drainage system which is susceptible of a low cost of manufacture with regard to both materials and labor, and which accordingly is then susceptible of low prices of sale to the consuming public, thereby making such air conditioner drainage system economically available to the buying public.

Lastly, it is another object of the present invention to provide a air conditioner drainage system for receiving drainage water from an air conditioner and dispersing the received water widely into the ground, the receiving and the dispersing being done in a safe, sanitary, ecological, convenient and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of an air conditioner drainage system constructed in accordance with the principles of the present invention.

FIG. 2 is a plan view of the system taken along line 2-2 of FIG. 1.

FIG. 3 is a cross sectional view of the system taken along line 3-3 of FIG. 1.

FIG. 4 is a cross sectional view of the system taken along line 4-4 of FIG. 3.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved air conditioner drainage system embodying the principles and concepts of the present invention and generally designated by the reference numeral 10 will be described.

The present invention, the air conditioner drainage system 10 for receiving drainage water from an air conditioner and for dispersing the received water widely into the ground, the receiving and the dispersing being done in a safe, sanitary, ecological, convenient and economical manner is comprised of a plurality of components. Such components in their broadest context include a housing and a plurality of stones. Such components are individually configured and correlated with respect to each other so as to attain the desired objective.

First provided is a building 14. The building has an air conditioner with a drain pipe 16 extending laterally from the building. The drain pipe has an outlet orifice 18 at an elevation above ground level adapted to dispense water from the air conditioner.

A hole 22 is formed beneath ground level. The hole has a minor section 24 in a cylindrical configuration with a vertical axis. The hole has a major section 26 in a generally semi-cylindrical configuration with a vertical axis. The minor and major sections are contiguous. The axes of the major and minor sections are coextensive. The axes are axially aligned beneath the outlet orifice. The major section is deeper than the minor section.

Next provided is a housing 30 in a cylindrical configuration with a height and a diameter and a circumference. The housing is located in the major section of the hole. The housing has a side wall 32 with a closed bottom 34 and an open top 36. The bottom is formed with a plurality of bottom apertures 38. The side wall is imperforate over the majority of its extent. The side wall has a plurality of wall apertures 40 over the minority of its extent from the bottom for between 70 and 80 percent of its height and for between 170 and 190 degrees of its circumference. The apertures in the side wall face away from the building.

Next, a lid 44 with a peripheral flange 46 is provided. The lid is positioned on the top of the housing. The lid and the flange are located above ground level. The lid is formed with lid apertures 48. The lid apertures include a central aperture vertically aligned beneath the outlet orifice. The lid apertures are adapted to allow water from the outlet orifice to enter the housing and be disbursed downwardly and laterally away from the building.

A plurality of screens is provided. The screens are within the housing. The screens include a wall screen 52 over the wall apertures, a bottom screen 54 over the bottom apertures, and a lid screen 56 over the lid apertures.

Lastly, a plurality of stones 60 is provided. The stones are in the major section of the hole beneath the bottom of the housing and laterally spaced from the wall apertures. A majority of the plurality of stones have a greatest dimension of between 0.25 inches and 2.00 inches. The plurality of stones has an axial height of between 110 and 125 percent of the height of the housing. The plurality of stones has a radial width of between 110 and 125 percent of the diameter of the housing. The plurality of stones is adapted to provide extended dispersion of water from the housing.

The air conditioning drainage system of the present invention disperses dripping air conditioner condensed water from a window air conditioner or from a central air conditioner unit. Typically, condensation from an air conditioning unit flow through a drain tube and into the ground. This condensed water collects in the area of the constant dripping. Usually, enough water collects that potentially becomes a nesting place for mosquito larvae or the water typically drains toward the building which can damage the integrity of the home building's foundation.

The air conditioning drainage system of the present invention allows for safe and sanitary removal of the dripping water by passing condensed water through the top holed filter housing lid. Most of the condensed water will exit through the bottomless part of the overcall system. Any excess water will drain through the sides of the holed filter housing, preferably of polyvinyl chloride. The filter membrane at the lid prevents any mosquito attempting to lay eggs into the tube and the filter membrane around the housing prevents any sand or dirt from penetrating into the housing. Finally several inches of drainage stones are placed around the apertured housing and at the bottom portion of the housing. The drainage stones allow water to safety permeate into the ambient soil environment.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An air conditioner drainage system (10) for receiving drainage water from an air conditioner and for dispersing the received water widely into the ground, the receiving and the dispersing being done in a safe, sanitary, ecological, convenient and economical manner, the system comprising, in combination:

a building (14) having an air conditioner with a drain pipe 16 extending laterally from the building, the drain pipe having an outlet orifice (18), the outlet orifice being at an elevation above ground level, the outlet orifice adapted to dispense water from the air conditioner;

a hole (22) formed beneath ground level, the hole having a minor section (24) in a cylindrical configuration with a vertical axis, the hole having a major section (26) in a generally semi-cylindrical configuration with a vertical axis, the minor and major sections being contiguous, the axes of the major and minor sections being coextensive, the axes being axially aligned beneath the outlet orifice, the major section being deeper than the minor section;

a housing (30) in a cylindrical configuration with a height and a diameter and a circumference, the housing being located in the minor section of the hole, the housing having a side wall (32) with a closed bottom (34) and an open top (36), the bottom being formed with a plurality of bottom apertures (38), the side wall being imperforate over the majority of its extent, the side wall having a plurality of wall apertures (40) over the minority of its extent from the bottom for between 70 and 80 percent of its height and for between 170 and 190 degrees of its circumference, the apertures in the side wall facing away from the building;

a lid (44) with a peripheral flange (46) positioned on the top of the housing, the lid and the flange being located above ground level, the lid being formed with lid apertures (48), the lid apertures including a central aperture vertically aligned beneath the outlet orifice, the lid apertures adapted to allow water from the outlet orifice to enter the housing and be disbursed downwardly and laterally away from the building;

a plurality of screens within the housing including a wall screen (52) over the wall apertures, a bottom screen (54) over the bottom apertures and a lid screen (56) over the lid apertures; and a plurality of stones (60) in the major section of the hole beneath the bottom of the housing and laterally spaced from the wall apertures, a majority of the plurality of stones having a greatest dimension of between 0.25 inches and 2.00 inches, the plurality of stones having an axial height of between 110 and 125 percent of the height of the housing, the plurality of stones having a radial width of between 110 and 125 percent of the diameter of the housing, the plurality of stones adapted to provide extended dispersion of water from the housing.

* * * * *